US011107446B2

(12) United States Patent
Coorough

(10) Patent No.: US 11,107,446 B2
(45) Date of Patent: Aug. 31, 2021

(54) GUITAR RESTRINGING DEVICE

(71) Applicant: Kevin Coorough, Tujunga, CA (US)

(72) Inventor: Kevin Coorough, Tujunga, CA (US)

( * ) Notice: Subject to any disclaimer, the term of this patent is extended or adjusted under 35 U.S.C. 154(b) by 0 days.

(21) Appl. No.: 16/720,649

(22) Filed: Dec. 19, 2019

(65) Prior Publication Data

US 2021/0193088 A1 Jun. 24, 2021

(51) Int. Cl.
*G10D 3/20* (2020.01)
*G10D 3/12* (2020.01)

(52) U.S. Cl.
CPC ..... *G10D 3/20* (2020.02); *G10D 3/12* (2013.01)

(58) Field of Classification Search
CPC ..... G10D 3/20; G10D 3/12; G10D 3/00
See application file for complete search history.

(56) References Cited

U.S. PATENT DOCUMENTS

2015/0047493 A1* 2/2015 Leadbetter ..... G10G 7/02 84/454

* cited by examiner

*Primary Examiner* — Kimberly R Lockett
(74) *Attorney, Agent, or Firm* — The Iwashko Law Firm, PLLC; Lev Ivan Gabriel Iwashko

(57) ABSTRACT

A guitar restringing device, including an outer plate body to connect to an outer surface of a guitar bridge, a plurality of string-receiving apertures disposed on at least a portion of a side of the outer plate body to receive at least one guitar string therein, and a plurality of ferrules disposed on at least a portion of a bottom surface of the outer plate body to be inserted into the guitar bridge and to prevent the at least one guitar string from movement away from the plurality of string-receiving apertures.

6 Claims, 6 Drawing Sheets

GUITAR RESTRINGING DEVICE

BACKGROUND

1. Field

The present general inventive concept relates generally to a restringing device, and particularly, to a guitar restringing device.

2. Description of the Related Art

Traditional guitar strings can be tedious and time consuming to replace because of the bridge peg mechanism. This process is problematic as it is not pragmatic because removing these pegs can take up a great deal of time.

The bridge peg is connected to a string on a guitar at a bridge to fasten the string on the bridge. Unfortunately, the bridge peg is a fragile item that can pop out of the bridge while playing the guitar and/or break while restringing the guitar.

Therefore, there is a need for a restringing device for a guitar that does not require removing the bridge peg, and is more efficient.

SUMMARY

The present general inventive concept provides a guitar restringing device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a guitar restringing device, including an outer plate body to connect to an outer surface of a guitar bridge, a plurality of string-receiving apertures disposed on at least a portion of a side of the outer plate body to receive at least one guitar string therein, and a plurality of ferrules disposed on at least a portion of a bottom surface of the outer plate body to be inserted into the guitar bridge and to prevent the at least one guitar string from movement away from the plurality of string-receiving apertures.

The outer plate body may include a recessed groove disposed on a side of the outer plate body to prevent the at least one guitar string from damaging an edge of the outer plate body.

Each of the plurality of ferrules may include a flange to contact a surface to prevent movement, and a threaded portion disposed on a bottom surface of the flange to receive a washer thereupon.

The guitar restringing device may further include an inner plate body to connect to an interior surface of the guitar bridge.

The guitar restringing device may further include a plurality of fasteners to connect to the inner plate body and the plurality of ferrules to prevent the outer plate body from moving away from the guitar bridge.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1A:
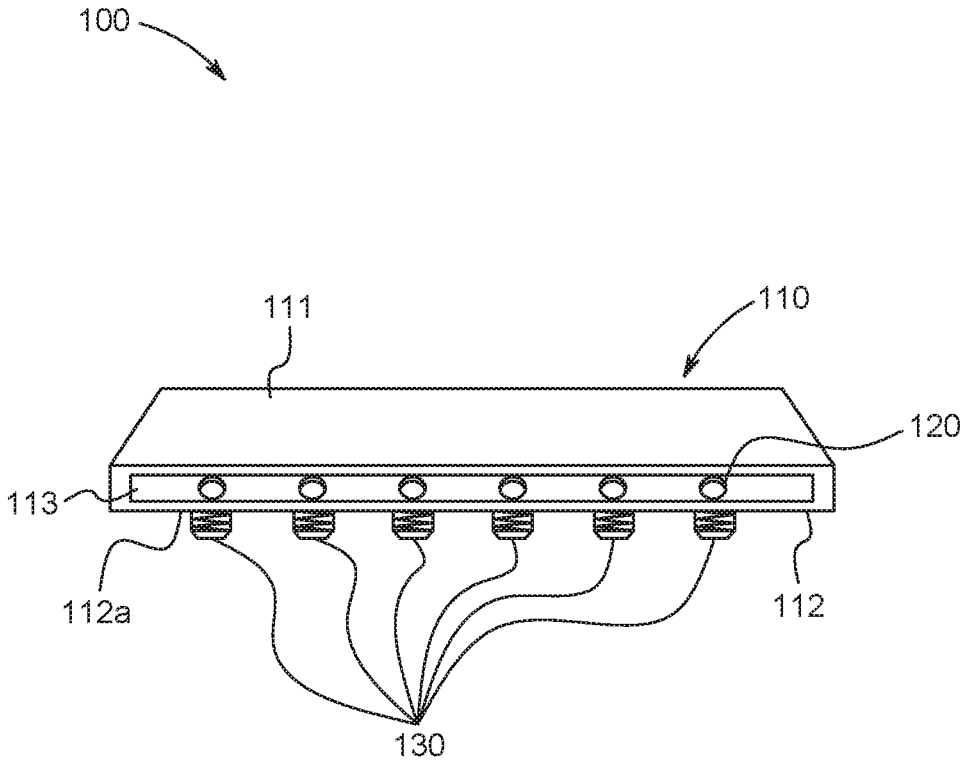
FIG. 1A illustrates an elevation view of a guitar restringing device, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Guitar Restringing Device 100
Outer Plate Body 110
Top Surface 111
Bottom Surface 112
Ferrule-Receiving Apertures 112*a*
Recessed Groove 113
String-Receiving Apertures 120
Ferrules 130
Flange 131
Threaded Portion 132
Inner Plate Body 140
Ferrule-Receiving Apertures 141
Fasteners 150

FIG. 1A illustrates an elevation view of a guitar restringing device 100, according to an exemplary embodiment of the present general inventive concept.

Figure 1B:
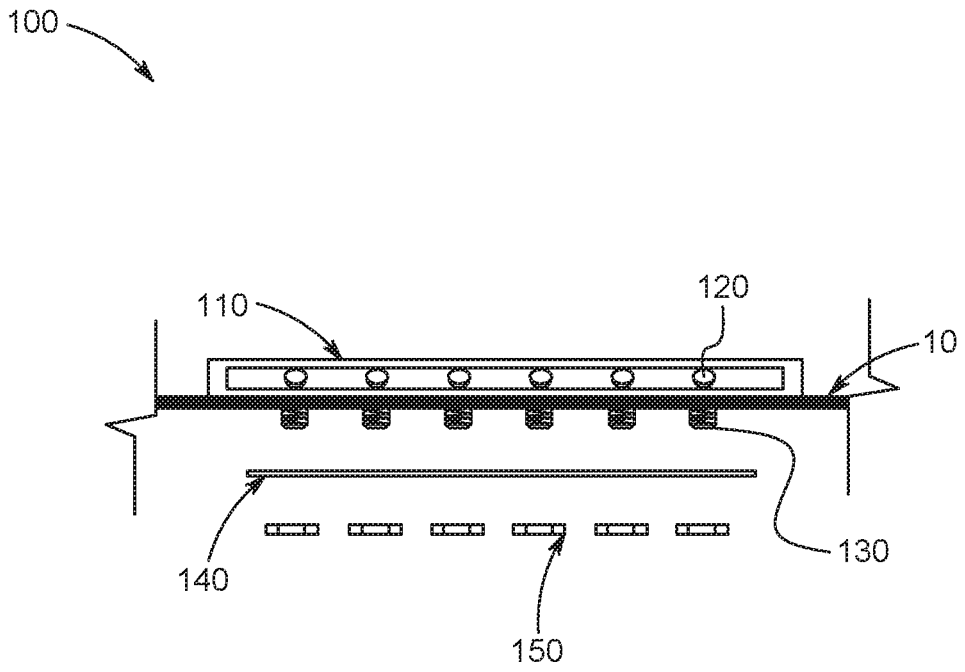
FIG. 1B illustrates a front view of the guitar restringing device, according to an exemplary embodiment of the present general inventive concept.

FIG. 1B illustrates a front view of the guitar restringing device 100, according to an exemplary embodiment of the present general inventive concept.

Figure 1C:
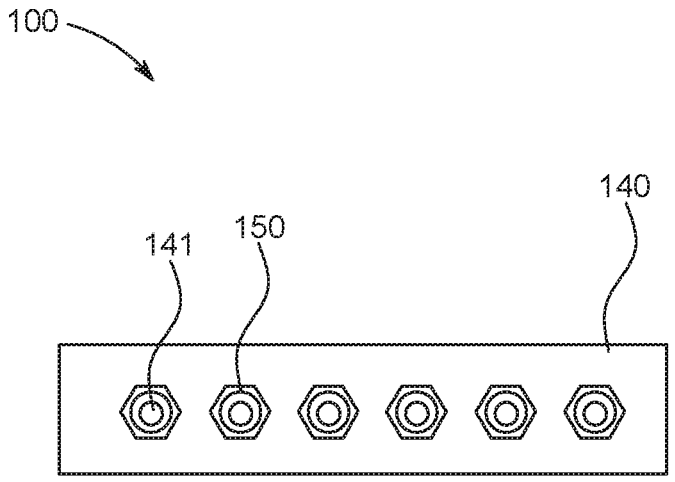
FIG. 1C illustrates a bottom view of an inner plate, according to an exemplary embodiment of the present general inventive concept.

FIG. 1C illustrates a bottom view of an inner plate 140, according to an exemplary embodiment of the present general inventive concept.

Figure 1D:
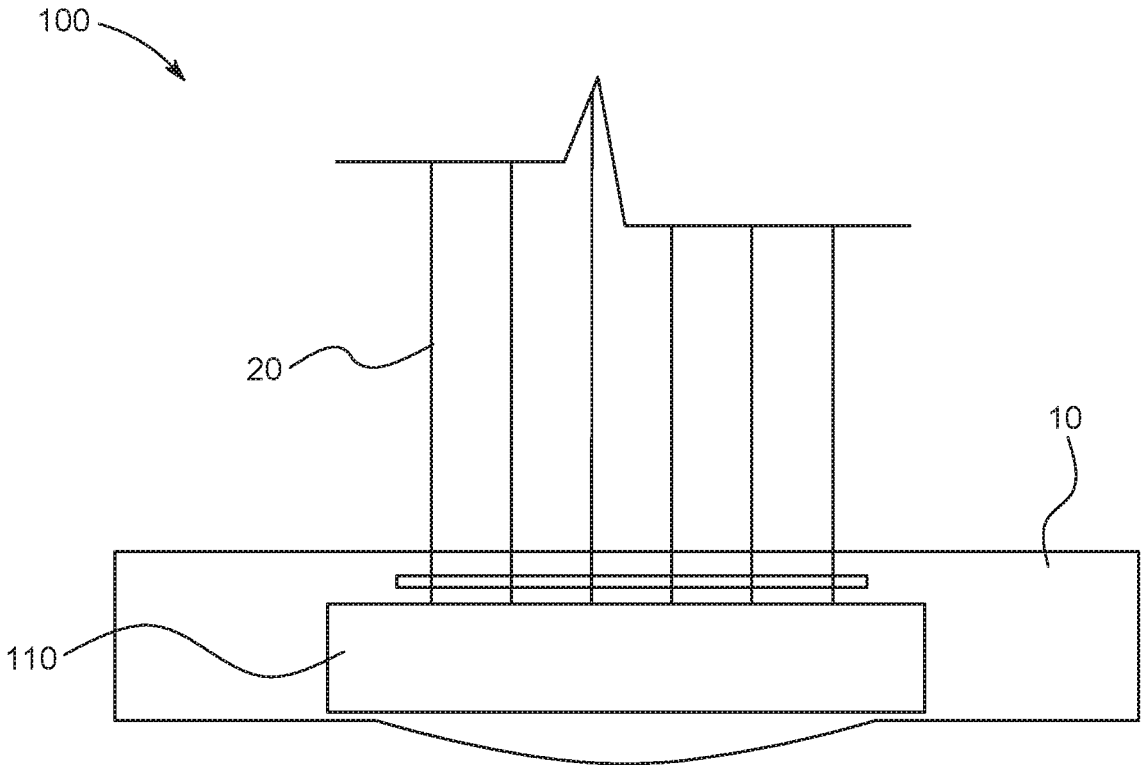
FIG. 1D illustrates a top view of the guitar restringing device as disposed on a guitar bridge, according to an exemplary embodiment of the present general inventive concept.

FIG. 1D illustrates a top view of the guitar restringing device 100 as disposed on a guitar bridge 10, according to an exemplary embodiment of the present general inventive concept.

The guitar restringing device 100 may be constructed from at least one of metal, brass, plastic, wood, and rubber, etc., but is not limited thereto.

The guitar restringing device 100 may include an outer plate body 110, a plurality of string-receiving apertures 120, a plurality of ferrules 130, an inner plate body 140, and a plurality of fasteners 150, but is not limited thereto.

Referring to FIGS. 1A through 1D, the outer plate body 110 and the inner plate body 140 are illustrated to have a rectangular prism shape. However, the outer plate body 110 and the inner plate body 140 may be rectangular, circular, pentagonal, hexagonal, octagonal, or any other shape known to one of ordinary skill in the art, but is not limited thereto.

The outer plate body 110 may include a top surface 111, a bottom surface 112, and a recessed groove 113, but is not limited thereto.

The outer plate body 110 may have a length of three and a half inches and a width of half an inch.

The bottom surface 112 may include a plurality of ferrule-receiving apertures 112*a*, but is not limited thereto.

The top surface 111 may be a surface of the outer plate body 110 that does not contact a guitar bridge 10. The top surface 111 may be designed to have an appearance of a guitar housing. In other words, the bottom surface 112 may contact at least a portion of an outer surface of the guitar bridge 10 during replacement of at least one guitar string 20.

The recessed groove 113 may be disposed on a side of the outer plate body 110. Moreover, the recessed groove 113 may be recessed with respect to the side of the outer plate body 110. The recessed groove 113 may prevent the at least one guitar string 20 from damaging an edge of the outer plate body 110.

The plurality of string-receiving apertures 120 may be disposed within at least a portion of the recessed groove 113. For example, each of the plurality of string-receiving apertures 120 may be disposed 0.45" apart. Additionally, each of the plurality of string-receiving apertures 120 may be disposed at a thirty degree angle with respect to a horizontal plane of the outer plate body 110, such as the top surface 111 and/or the bottom surface 112.

Furthermore, each of the plurality of string-receiving apertures 120 may receive the at least one guitar string 20 therein.

Figure 2A:
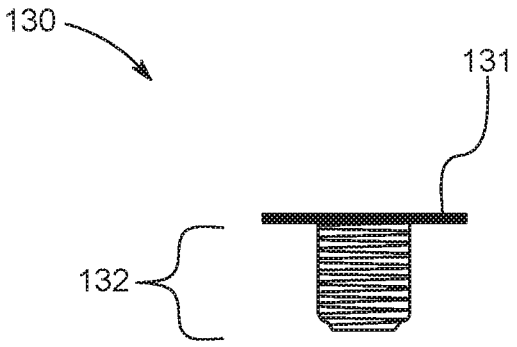
FIG. 2A illustrates a side view of a ferrule, according to an exemplary embodiment of the present general inventive concept.

FIG. 2A illustrates a side view of a ferrule 130, according to an exemplary embodiment of the present general inventive concept.

Figure 2B:
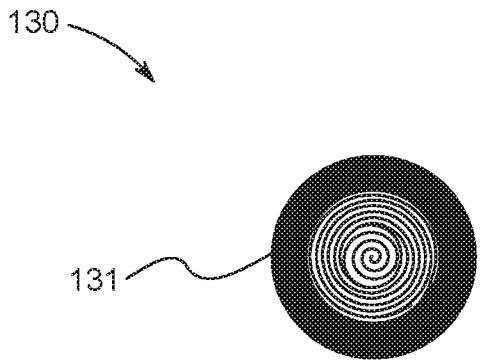
FIG. 2B illustrates a top view of the ferrule, according to an exemplary embodiment of the present general inventive concept.

FIG. 2B illustrates a top view of the ferrule 130, according to an exemplary embodiment of the present general inventive concept.

Each of the plurality of ferrules 130 may include a flange 131 and a threaded portion 132, but is not limited thereto.

The threaded portion 132 may be disposed on a bottom surface of the flange 131. Each of the plurality of ferrules 130 may be disposed through the plurality of ferrule-receiving apertures 112*a* as disposed on the bottom surface 112 of the outer plate body 110 to be inserted in the guitar bridge 10. More specifically, the bottom surface 112 may be pivotally disposed on another side of the outer plate body 110, such that the bottom surface 112 may pivot from closed in a first position to at least partially open in a second position.

Additionally, each of the plurality of ferrules 130 may be inserted and/or exchanged while the bottom surface 112 is opened. Furthermore, the threaded portion 132 may be inserted through at least one of the ferrule-receiving apertures 112*a*, such that the flange 131 contacts an inner surface of the bottom surface 112, such that at least one of the plurality of ferrules 130 may be prevented from moving through the at least one of the ferrule-receiving apertures 112*a*.

Additionally, the at least one guitar string 20 within at least one of the plurality of string-receiving apertures 120 may connect to the at least one the plurality of ferrules 130. For example, the at least one guitar string 20 may wrap around the threaded portion 132 within the outer plate body 130 and/or the flange 131 may connect to an inner surface of the top surface 111 within the outer plate body 110, such that the at least one guitar string 20 may be prevented from movement. Also, the threaded portion 132 may receive a washer thereupon to prevent damage from the at least one guitar string 20 to the plurality of ferrules 130. For example, the washer may prevent the at least one guitar string 20 from scratching the plurality of ferrules 130 during playing of the guitar.

Subsequently, the bottom surface 112 may be closed prior to connecting to the guitar bridge 10 via the plurality of ferrules 130.

The inner plate body 140 may include a plurality of ferrule-receiving apertures 141, but is not limited thereto.

Each of the plurality of ferrules 130 may be disposed through the plurality of ferrule-receiving apertures 141 within the inner plate body 140.

The plurality of fasteners 150 may include a washer and a nut, but is not limited thereto.

Referring to FIG. 1B, each of the plurality of fasteners 150 may connect to the threaded portion 132 of each of the plurality of ferrules 130. In other words, the threaded portion 132 may receive at least one of the plurality of fasteners 150 thereupon. A top surface of the inner plate body 140 may connect to an interior surface of the guitar bridge 10. Also, each of the plurality of fasteners 150 may be disposed on a bottom surface of the inner plate body 140. As such, the plurality of fasteners 150 may prevent the outer plate body 110 from moving away from the guitar bridge 10.

The at least one guitar string 20 may be connected within the outer plate body 110, such that the at least one guitar string 20 may be exchanged or installed without relying on a bridge peg. Therefore, the guitar restringing device 100 may replace the at least one guitar string 20 without risk of damaging the bridge peg because the bridge peg is not needed for removal.

The present general inventive concept may include a guitar restringing device 100, including an outer plate body 110 to connect to an outer surface of a guitar bridge 10, a plurality of string-receiving apertures 120 disposed on at least a portion of a side of the outer plate body 110 to receive at least one guitar string 20 therein, and a plurality of ferrules 130 disposed on at least a portion of a bottom surface of the outer plate body 110 to be inserted into the guitar bridge 10 and to prevent the at least one guitar string 20 from movement away from the plurality of string-receiving apertures 120.

The outer plate body 110 may include a recessed groove 113 disposed on a side of the outer plate body 110 to prevent the at least one guitar string 20 from damaging an edge of the outer plate body 110.

Each of the plurality of ferrules 130 may include a flange 131 to contact a surface to prevent movement, and a threaded portion 132 disposed on a bottom surface of the flange 131 to receive a washer thereupon.

The guitar restringing device 100 may further include an inner plate body 140 to connect to an interior surface of the guitar bridge 10.

The guitar restringing device 100 may further include a plurality of fasteners 150 to connect to the inner plate body 140 and the plurality of ferrules 130 to prevent the outer plate body 110 from moving away from the guitar bridge 10.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A guitar device, comprising:

an outer plate body to connect to an outer surface of a guitar bridge, the outer plate body comprising:

a recessed groove disposed on a side of the outer plate body to prevent the at least one guitar string from damaging an edge of the outer plate body;

a plurality of string-receiving apertures disposed on at least a portion of a side of the outer plate body to receive at least one guitar string therein; and a plurality of ferrules disposed on at least a portion of a bottom surface of the outer plate body to be inserted into the guitar bridge and to prevent the at least one guitar string from movement away from the plurality of string-receiving apertures.

2. The guitar device of claim 1, wherein each of the plurality of ferrules comprises:

a flange to contact a surface to prevent movement; and a threaded portion disposed on a bottom surface of the flange to receive a washer thereupon.

3. The guitar device of claim 1, further comprising:

an inner plate body to connect to an interior surface of the guitar bridge.

4. The guitar device of claim 3, further comprising:

a plurality of fasteners to connect to the inner plate body and the plurality of ferrules to prevent the outer plate body from moving away from the guitar bridge.

5. A guitar device, comprising:

an outer plate body to connect to an outer surface of a guitar bridge;

a plurality of string-receiving apertures disposed on at least a portion of a side of the outer plate body to receive at least one guitar string therein; and a plurality of ferrules disposed on at least a portion of a bottom surface of the outer plate body to be inserted into the guitar bridge and to prevent the at least one guitar string from movement away from the plurality of string-receiving apertures, each of the plurality of ferrules comprising:

a flange to contact a surface to prevent movement, and a threaded portion disposed on a bottom surface of the flange to receive a washer thereupon.

6. A guitar device, comprising:

an outer plate body to connect to an outer surface of a guitar bridge;

a plurality of string-receiving apertures disposed on at least a portion of a side of the outer plate body to receive at least one guitar string therein;

a plurality of ferrules disposed on at least a portion of a bottom surface of the outer plate body to be inserted into the guitar bridge and to prevent the at least one guitar string from movement away from the plurality of string-receiving apertures;

an inner plate body to connect to an interior surface of the guitar bridge; and a plurality of fasteners to connect to the inner plate body and the plurality of ferrules to prevent the outer plate body from moving away from the guitar bridge.

* * * * *